US011898442B2

(12) United States Patent
Anifowose et al.

(10) Patent No.: US 11,898,442 B2
(45) Date of Patent: Feb. 13, 2024

(54) METHOD AND SYSTEM FOR FORMATION PORE PRESSURE PREDICTION WITH AUTOMATIC PARAMETER REDUCTION

(71) Applicant: SAUDI ARABIAN OIL COMPANY, Dhahran (SA)

(72) Inventors: Fatai A. Anifowose, Al-Khobar (SA); Mokhles M. Mezghani, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/651,194

(22) Filed: Feb. 15, 2022

(65) Prior Publication Data

US 2023/0258078 A1 Aug. 17, 2023

(51) Int. Cl.
*E21B 49/00* (2006.01)
*E21B 45/00* (2006.01)

(52) U.S. Cl.
CPC ..... *E21B 49/005* (2013.01); *E21B 45/00* (2013.01); *E21B 49/003* (2013.01); *E21B 2200/20* (2020.05); *E21B 2200/22* (2020.05)

(58) Field of Classification Search
CPC ..... E21B 49/005; E21B 45/00; E21B 49/003; E21B 2200/20; E21B 2200/22
See application file for complete search history.

(56) References Cited

U.S. PATENT DOCUMENTS 11,410,073 B1 * 8/2022 Narsky ..... G06N 20/00
2011/0119040 A1 * 5/2011 Mclennan ..... G06F 17/18 703/2
2014/0116776 A1 * 5/2014 Marx ..... E21B 49/00 706/11
2016/0222741 A1 * 8/2016 Lovorn ..... E21B 44/00
2017/0260855 A1 * 9/2017 Yang ..... E21B 49/005

FOREIGN PATENT DOCUMENTS

WO 2016134376 A1 8/2016
WO 2021102064 A1 5/2021
WO 2021150929 A1 7/2021

OTHER PUBLICATIONS

ArabAmeri et al.; "Enhanced velocity-based pore-pressure prediction using lithofacies clustering: a case study from a reservoir with complex lithology in Dezful Embayment, SW Iran", Journal of Geophysics and Engineering; vol. 16; Issue 1; Jan. 31, 2019; pp. 146-158 (13 pages).

(Continued)

*Primary Examiner* — Abby J Flynn
*Assistant Examiner* — Yanick A Akaragwe
(74) *Attorney, Agent, or Firm* — Osha Bergman Watanabe & Burton LLP

(57) ABSTRACT

A method for formation pore pressure prediction involves obtaining an input parameter set while drilling a well. The input parameter set includes surface drilling parameters, logging while drilling parameters, and advanced mud gas measurements. The method further involves generating, from the input parameter set, a reduced input parameter set, by eliminating at least one input parameter of the input parameter set that is considered non-relevant for predicting the pore pressure, and predicting the pore pressure by applying a machine learning model to the reduced input parameter set.

14 Claims, 6 Drawing Sheets

(56) References Cited

OTHER PUBLICATIONS

Ahmed S et al.; "Artificial Neural Network ANN Approach to Predict Fracture Pressure", SPE-194852-MS; Society of Petroleum Engineers; Mar. 15, 2019; pp. 1-9 (9 pages).
Hutomo et al.; "Pore Pressure Prediction Using Eaton and Neural Network Method in Carbonate Field 'X' Based on Seismic Data", IOP Conference Series: Materials Science and Engineering; vol. 546; Issue 3; Jun. 2019; pp. 1-7 (7 pages).
Hadi et al.; "Real-Time Pore Pressure Prediction in Depleted Reservoirs Using Regression Analysis and Artificial Neural Networks", SPE-194851-MS; Society of Petroleum Engineers; Mar. 15, 2019; pp. 1-14 (14 pages).
Dutta et al.; "Geopressure Detection and Prediction in Real Time.", Quantitative Analysis of Geopressure for Geoscientists and Engineers; Cambridge University Press; Feb. 10, 2021; pp. 348-367 (20 pages).
Azadpour et al.; "Pore pressure prediction and modeling using well-logging data in one of the gas fields in south of Iran", Journal of Petroleum Science and Engineering; vol. 128; Apr. 1, 2015; pp. 15-23 (9 pages).
Liu et al.; "Abnormal formation velocities and applications to pore pressure prediction", Journal of Applied Geophysics; vol. 153; Jun. 2018; pp. 1-6 (6 pages).
Liu et al.; "A new quantitative model and application for overpressure prediction in carbonate formation", Journal of Petroleum Science and Engineering; vol. 198; Mar. 2021; pp. 1-15 (15 pages).
Farsi et al.; "Predicting Formation Pore-Pressure from Well-log Data with Hybrid Machine-Learning Optimization Algorithms", Natural Resources Research; vol. 30; Apr. 1, 2021; pp. 3455-3481 (27 pages).
Maryam Farzad, "The application of big data analysis and machine learning for kick detection and kick prediction during drilling operations", Master's Thesis; University of Stavanger, Jun. 2021 (128 pages).

* cited by examiner

METHOD AND SYSTEM FOR FORMATION PORE PRESSURE PREDICTION WITH AUTOMATIC PARAMETER REDUCTION

BACKGROUND

Formation pore pressure analyses may be performed during different stages of a drilling project: a pre-drill pore pressure prediction, a pore pressure prediction while drilling and/or a post-well pore pressure analysis may be performed. The pre-drill pore pressure may be predicted using seismic interval velocity data at the planned well location as well as geological, well logging and drilling data obtained from offset wells. The post-well analysis may be performed to analyze pore pressure in the drilled well using all available data to build pore pressure model, which can be used for pre-drill pore pressure predictions in other future wells. Many different types of data may be acquired during the drilling. At least some of these data may be related to formation pore pressure. For example, the pore pressure prediction while drilling may be based on logging while drilling (LWD) data, measurement while drilling (MWD) data, drilling parameters, and mud lithology data. These data may be used to determine pore pressure based on overburden and effective stresses. The overburden stress may be obtained from bulk density logs, while effective stress may be obtained based on being correlated with well log data, such as resistivity, sonic travel time/velocity, bulk density and drilling parameters (e.g., D exponent). In other words, many different types of data may be obtained during drilling. At least some of these data may be correlated with formation pore pressure.

Formation pore pressure is an important variable for drilling operations. For example, based on knowledge of the pore pressure, a drilling mud weight may be selected to avoid unsafe kicks during the drilling. Accordingly, real-time availability of an estimate of pore pressure during drilling would be beneficial. However, due to the volume and heterogeneity of the data obtained while drilling, real-time prediction of pore pressure is challenging.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method for formation pore pressure prediction, the method comprising: obtaining an input parameter set while drilling a well, the input parameter set comprising: surface drilling parameters, logging while drilling parameters, and advanced mud gas measurements; generating, from the input parameter set, a reduced input parameter set, by eliminating at least one input parameter of the input parameter set that is considered non-relevant for predicting the pore pressure; and predicting the pore pressure by applying a machine learning model to the reduced input parameter set.

In general, in one aspect, embodiments relate to a system for formation pore pressure prediction, the system comprising: at least one processor configured to: receive an input parameter set while drilling a well, the input parameter set comprising: surface drilling parameters, logging while drilling parameters, and advanced mud gas measurements; generate, from the input parameter set, a reduced input parameter set, by eliminating at least one input parameter of the input parameter set that is considered non-relevant for predicting the pore pressure; and predict the pore pressure by applying a machine learning model to the reduced input parameter set.

In general, in one aspect, embodiments relate to a non-transitory machine-readable medium comprising a plurality of machine-readable instructions executed by one or more processors, the plurality of machine-readable instructions causing the one or more processors to perform operations comprising: obtaining an input parameter set while drilling a well, the input parameter set comprising: surface drilling parameters, logging while drilling parameters, and advanced mud gas measurements; generating, from the input parameter set, a reduced input parameter set, by eliminating at least one input parameter of the input parameter set that is considered non-relevant for predicting a pore pressure; and predicting the pore pressure by applying a machine learning model to the reduced input parameter set.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
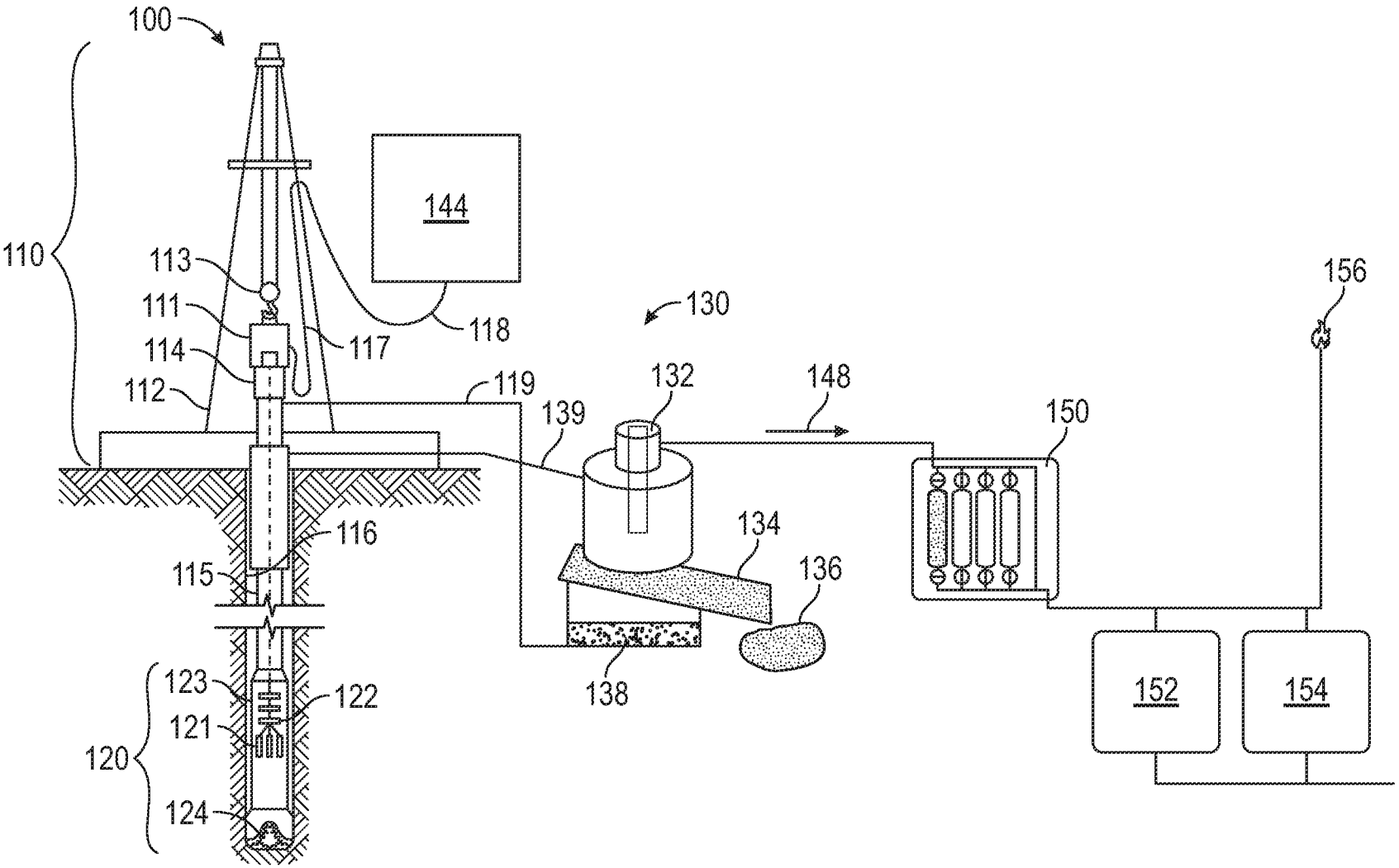
FIG. 1 shows a system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for a formation pore pressure prediction performed after a parameter reduction.

During drilling, real-time data may be acquired from multiple different sources. For example, surface drilling parameters may be obtained from the sensors attached to the drilling framework; logging while drilling (LWD) data may be obtained from the sensors attached to the drill pipe in the wellbore, and/or advanced mud gas measurements may be obtained from gas chromatographs and/or spectrometers on the rig platform. These massive data may include measurements for numerous parameters, e.g., for over 35 input parameters. The relevance of these measurements for the purpose of estimating formation pore pressure may differ. For example, some of the measurements, such as those from advanced mud gas, may be less relevant as they may be composed majorly of zeros or some constant values. Accordingly, while one may use all measurements to perform an estimation of the formation pore pressure, reducing the input parameter set to measurements that contain information on the formation pore pressure may have various benefits. One or more embodiments of the disclosure identify an optimal subset of the input parameters, e.g., ten measurements of originally over 35 measurements corresponding to the most highly correlated parameters from the available data sources. The parameter reduction of the original parameter set may be performed by applying some linear and/or nonlinear sensitivity-based parameter reduction methodologies "on-the-fly" to extract the subset of the input parameters that positively or optimally influences the accuracy of the prediction of formation pore pressure. The parameter reduction may be performed based on a training performed on historical data, and may then be applied in real-time, as measurements are obtained during drilling operations. Embodiments of the disclosure provide various benefits. Embodiments of the disclosure address the challenge of increased project complexity and suboptimality associated with using all available data from multiple sources to predict formation pore pressure. Focusing on only the more relevant input parameters helps make the resulting machine learning models memory-efficient and fast to compute. The machine learning models may, thus, be suitable for real-time operation. Further, the elimination of less relevant or irrelevant input parameters may increase the accuracy of the machine learning models, and may also provide a more intuitive insight into formation. Also, the machine learning models may be generated with little to no human intervention. A detailed description is subsequently provided.

Turning to FIG. 1, FIG. 1 shows a drilling system (100) that may include a top drive drilling rig (110) arranged around the setup of a drill bit logging tool (120). A top drive drilling rig (110) may include a top drive (111) that may be suspended in a derrick (112) by a travelling block (113). In the center of the top drive (111), a drive shaft (114) may be coupled to a top pipe of a drill string (115), for example, by threads. The top drive (111) may rotate the drive shaft (114), so that the drill string (115) and a drill bit logging tool (120) cut the rock at the bottom of a wellbore (116). A power cable (117) supplying electric power to the top drive (111) may be protected inside one or more service loops (118) coupled to a control system (144). As such, drilling mud may be pumped into the wellbore (116) through a mud line (119), the drive shaft (114), and/or the drill string (115).

The control system (144) may include one or more programmable logic controllers (PLCs) that include hardware and/or software with functionality to control one or more processes performed by the drilling system (100). Specifically, a programmable logic controller may control valve states, fluid levels, pipe pressures, warning alarms, and/or pressure releases throughout a drilling rig. In particular, a programmable logic controller may be a ruggedized computer system with functionality to withstand vibrations, extreme temperatures, wet conditions, and/or dusty conditions, for example, around a drilling rig. For example, the control system (144) may be coupled to the sensor assembly (123) in order to perform various program functions for up-down steering and left-right steering of the drill bit (124) through the wellbore (116). While one control system is shown in FIG. 1, the drilling system (100) may include multiple control systems for managing various well drilling operations, maintenance operations, well completion operations, and/or well intervention operations. The control system (144) may be based on a computer system as shown FIG. 4.

The wellbore (116) may include a bored hole that extends from the surface into a target zone of the hydrocarbon-bearing formation, such as the reservoir. An upper end of the wellbore (116), terminating at or near the surface, may be referred to as the "up-hole" end of the wellbore (116), and a lower end of the wellbore, terminating in the hydrocarbon-bearing formation, may be referred to as the "down-hole" end of the wellbore (116). The wellbore (116) may facilitate the circulation of drilling fluids during well drilling operations, the flow of hydrocarbon production ("production") (e.g., oil and gas) from the reservoir to the surface during production operations, the injection of substances (e.g., water) into the hydrocarbon-bearing formation or the reservoir during injection operations, or the communication of monitoring devices (e.g., logging tools) into the hydrocarbon-bearing formation or the reservoir during monitoring operations (e.g., during in situ logging operations). In one or more embodiments, a drilling fluid circulation system (130) includes the mud line (119), a separator tank (132), a shaker and/or filter (134), a mud tank (138), and a mud return line (139). During the drilling, the drilling fluid, e.g., the drilling mud, is supplied via the mud line (119) from the mud tank (138). The drilling mud with cuttings (136) resulting from the drilling is returned to the separator tank (132) via the mud return line (139). In the separator tank (132), the cuttings (136) may be separated from the drilling mud by the shaker and/or filter (134). Further, a gas mixture (148) may be separated from the drilling mud returned from the well via the mud return line (139). The gas mixture (148) may be processed by a gas sampler (150) to obtain gas samples for analysis by a gas mass spectrometer (152) and/or a gas chromatograph (154). In one or more embodiments, the gas mass spectrometer (152) and/or a gas chromatograph (154) acquire advanced mud gas parameters which may be included in the input parameters for the formation pore pressure prediction. The gas mixture may then be released or processed via an exhaust (156).

As further shown in FIG. 1, sensors (121) may be included in a sensor assembly (123), which is positioned adjacent to a drill bit (124) and coupled to the drill string (115). Sensors (121) may also be coupled to a processor assembly (123) that includes a processor, memory, and an analog-to-digital converter (122) for processing sensor measurements. For example, the sensors (121) may include acoustic sensors, such as accelerometers, measurement microphones, contact microphones, and hydrophones. Likewise, the sensors (121) may include other types of sensors, such as transmitters and receivers to measure resistivity, gamma ray detectors, etc. The sensors (121) may include hardware and/or software for generating different types of well logs (such as acoustic logs or sonic longs) that may provide well data about a wellbore, including porosity of wellbore sections, gas saturation, bed boundaries in a geologic formation, fractures in the wellbore or completion cement, and many other pieces of information about a formation. If such well data is acquired during well drilling operations (i.e., logging-while-drilling (LWD)), then the information may be used to make adjustments to drilling operations in real-time. Such adjustments may include rate of penetration (ROP), drilling direction, altering mud weight, and many others drilling parameters.

In some embodiments, acoustic sensors may be installed in the drilling fluid circulation system (130) of a drilling system (100) to record acoustic drilling signals in real-time. Drilling acoustic signals may transmit through the drilling fluid to be recorded by the acoustic sensors located in the drilling fluid circulation system (130). The recorded drilling acoustic signals may be processed and analyzed to determine well data, such as lithological and petrophysical properties of the rock formation. This well data may be used in various applications, such as steering a drill bit using geosteering, casing shoe positioning, etc.

One or more of the drilling parameters, including drilling surface parameters, logging-while-drilling (LWD) parameters, advanced mud gas parameters, and/or any other available parameters may be used for the prediction of formation pore pressure. The drilling surface parameters may include, but are not limited to, the rate of penetration (ROP), the weight on bit (WOB), the torque, the revolutions per minute (RPM), the hook load, the mud flow rate, the D-exponent, the mud density, the standpipe pressure, and/or the mud temperature. The LWD parameters may include, but are not limited to, gamma ray, sonic, resistivity, and/or neutron porosity recordings. The advanced mud gas parameters may capture different gas components ranging from the light (C1, C2, C2S, C3, iC4, nC4, iC5, nC5) to the heavy (Benzene, Toluene, Helium, MethylCycloHexane) gas components as well as the organic (all the afore-mentioned) and inorganic (CO2, H2, H2S) gas components.

One or more components of the drilling system (100) may form a system for formation pore pressure prediction with parameter reduction. The system for formation pore pressure prediction with parameter reduction may include a computing system such as the computing system shown in FIG. 4. The computing system may be the control system (144) or any other computing system. The computing system, in one or more embodiments performs a method for formation pore pressure prediction with parameter reduction, as shown in FIGS. 2A, 2B, 3A, and 3B. The system for formation pore pressure prediction with parameter reduction may include other components, in addition to the computing system. For example, the system for formation pore pressure prediction may include the data sources providing the input parameters used for estimating the pore pressure.

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic and acid stimulation of a reservoir region, and/or installing a production tree or wellhead assembly at the wellbore (116). Likewise, well operations may include open-hole completions or cased-hole completions. For example, an open-hole completion may refer to a well that is drilled to the top of the hydrocarbon reservoir. Thus, the well is cased at the top of the reservoir, and left open at the bottom of a wellbore. In contrast, cased-hole completions may include running casing into a reservoir region. Cased-hole completions are discussed further below with respect to perforation operations.

In one well operation example, the sides of the wellbore (116) may require support, and thus casing may be inserted into the wellbore (116) to provide such support. After a well has been drilled, casing may ensure that the wellbore (116) does not close in upon itself, while also protecting the wellstream from outside incumbents, like water or sand. Likewise, if the formation is firm, casing may include a solid string of steel pipe that is run on the well and will remain that way during the life of the well. In some embodiments, the casing includes a wire screen liner that blocks loose sand from entering the wellbore (116).

In another well operation example, a space between the casing and the untreated sides of the wellbore (116) may be cemented to hold a casing in place. This well operation may include pumping cement slurry into the wellbore (116) to displace existing drilling fluid and fill in this space between the casing and the untreated sides of the wellbore (116). Cement slurry may include a mixture of various additives and cement. After the cement slurry is left to harden, cement may seal the wellbore (116) from non-hydrocarbons that attempt to enter the wellstream. In some embodiments, the cement slurry is forced through a lower end of the casing and into an annulus between the casing and a wall of the wellbore (116). More specifically, a cementing plug may be used for pushing the cement slurry from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

Keeping with well operations, some embodiments include perforation operations. More specifically, a perforation operation may include perforating casing and cement at different locations in the wellbore (116) to enable hydrocarbons to enter a wellstream from the resulting holes. For example, some perforation operations include using a perforation gun at different reservoir levels to produce holed sections through the casing, cement, and sides of the wellbore (116). Hydrocarbons may then enter the wellstream through these holed sections. In some embodiments, perforation operations are performed using discharging jets or shaped explosive charges to penetrate the casing around the wellbore (116).

In another well operation, a filtration system may be installed in the wellbore (116) in order to prevent sand and other debris from entering the wellstream. For example, a gravel packing operation may be performed using a gravel-packing slurry of appropriately sized pieces of coarse sand or gravel. As such, the gravel-packing slurry may be pumped into the wellbore (116) between a casing's slotted liner and the sides of the wellbore (116). The slotted liner and the gravel pack may filter sand and other debris that might have otherwise entered the wellstream with hydrocarbons.

In some embodiments, well intervention operations may include various operations carried out by one or more service entities for an oil or gas well during its productive life (e.g., fracking operations, CT, flow back, separator, pumping, wellhead and Christmas tree maintenance, slickline, wireline, well maintenance, stimulation, braded line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore (116) prior to delivering the well to a producing entity.

While FIG. 1 shows various configurations of components, other configurations may be used without departing from the scope of the disclosure. For example, various components in FIG. 1 may be combined to create a single component. As another example, the functionality performed by a single component may be performed by two or more components.

Figure 2A:
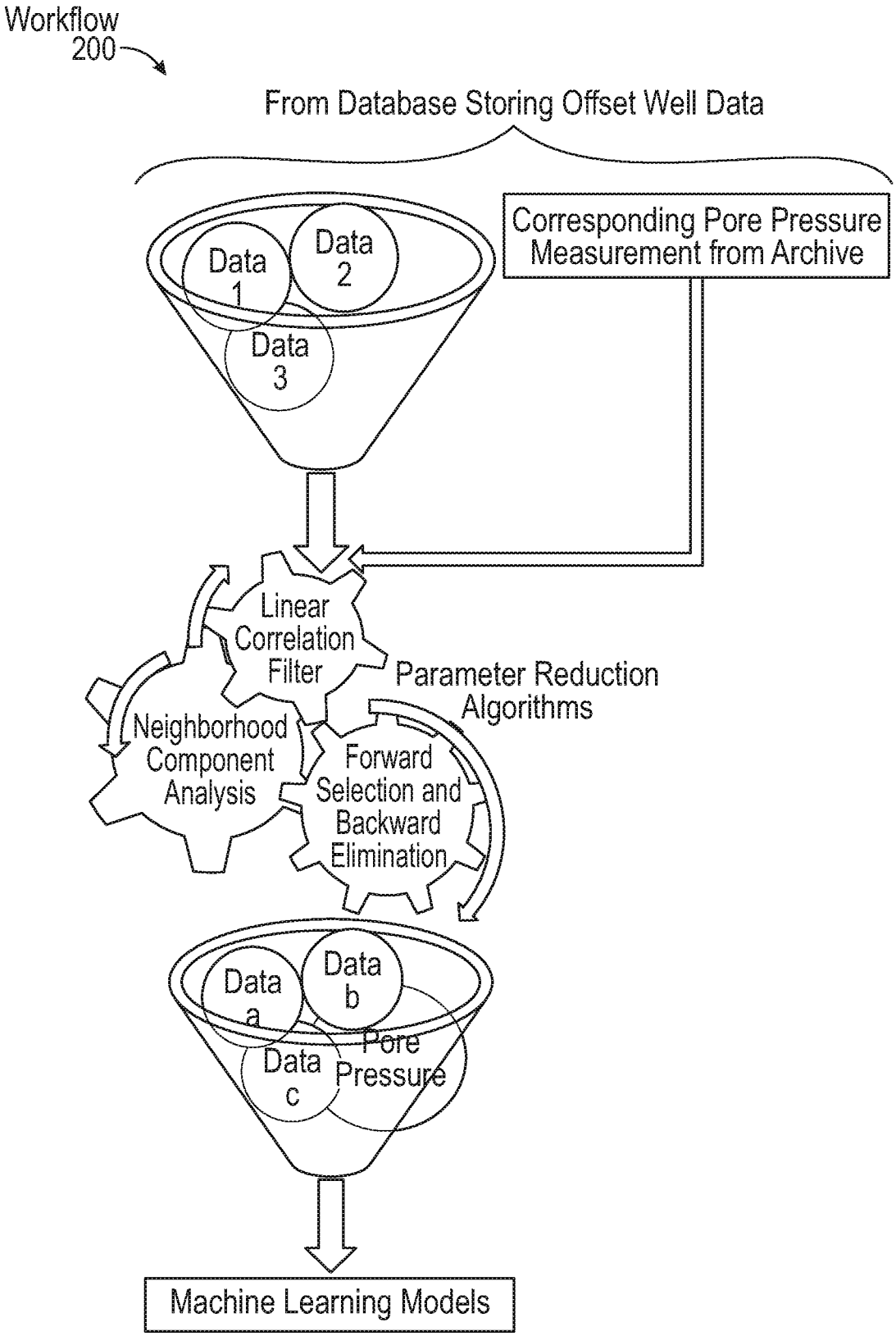
FIG. 2A schematically illustrates a workflow for input parameter reduction, in accordance with one or more embodiments.
Figure 2B:
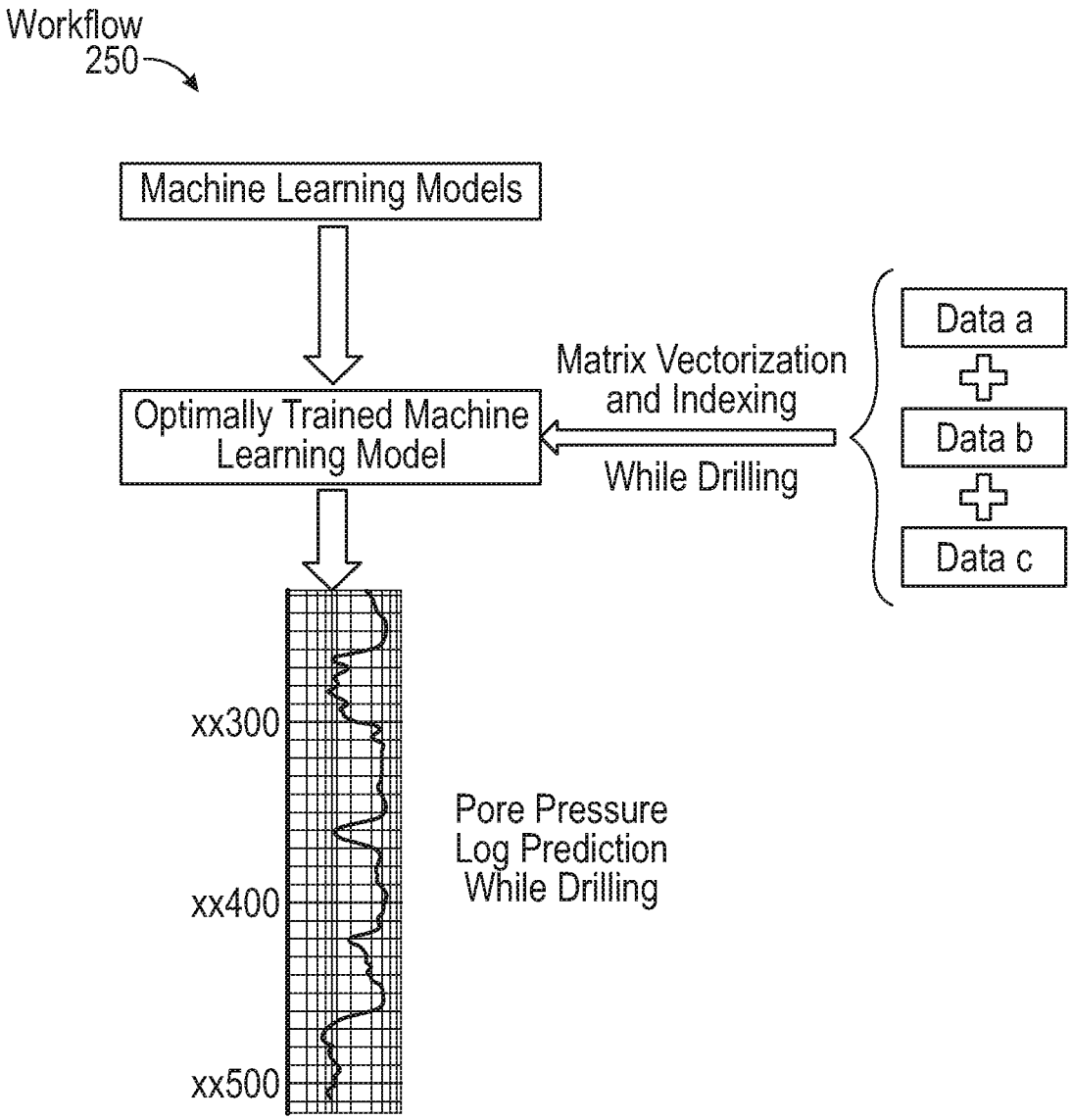
FIG. 2B schematically illustrates a workflow for predicting pore pressure, in accordance with one or more embodiments.

FIGS. 2A and 2B schematically illustrate the operation of a system for formation pore pressure prediction with parameter reduction, in accordance with one or more embodiments. Pore pressure may be estimated based on shale properties derived from well log data. These may include, for example, acoustic travel time/velocity and resistivity. Further, pore pressure may be estimated using other wireline logs such as true vertical depth (TVD), unconfined compressive strength (UCS), gamma ray, neutron porosity (NPHI), and bulk density (RHOZ). Pore pressure may also be estimated from combined drilling parameters and log data, namely weight on bit (WOB), rotary speed (RPM), rate of penetration (ROP), mud weight (MW), bulk density (RHOB), and porosity, based on seismic data, or rock elastic properties. The operations as shown in FIGS. 2A and 2B enable a prediction of the formation pore pressure from integrated multidimensional data. For example, some or all of the above input parameters and/or additional input parameters, not previously mentioned, may be considered. In one or more embodiments, a parameter reduction is performed to extract the most significant input parameters, which may subsequently be used for the pore pressure prediction. The described approach, in one or more embodiments, reduces the computational load and/or memory requirements, thus making it suitable for real-time formation pore pressure prediction during drilling.

Figure 3A:
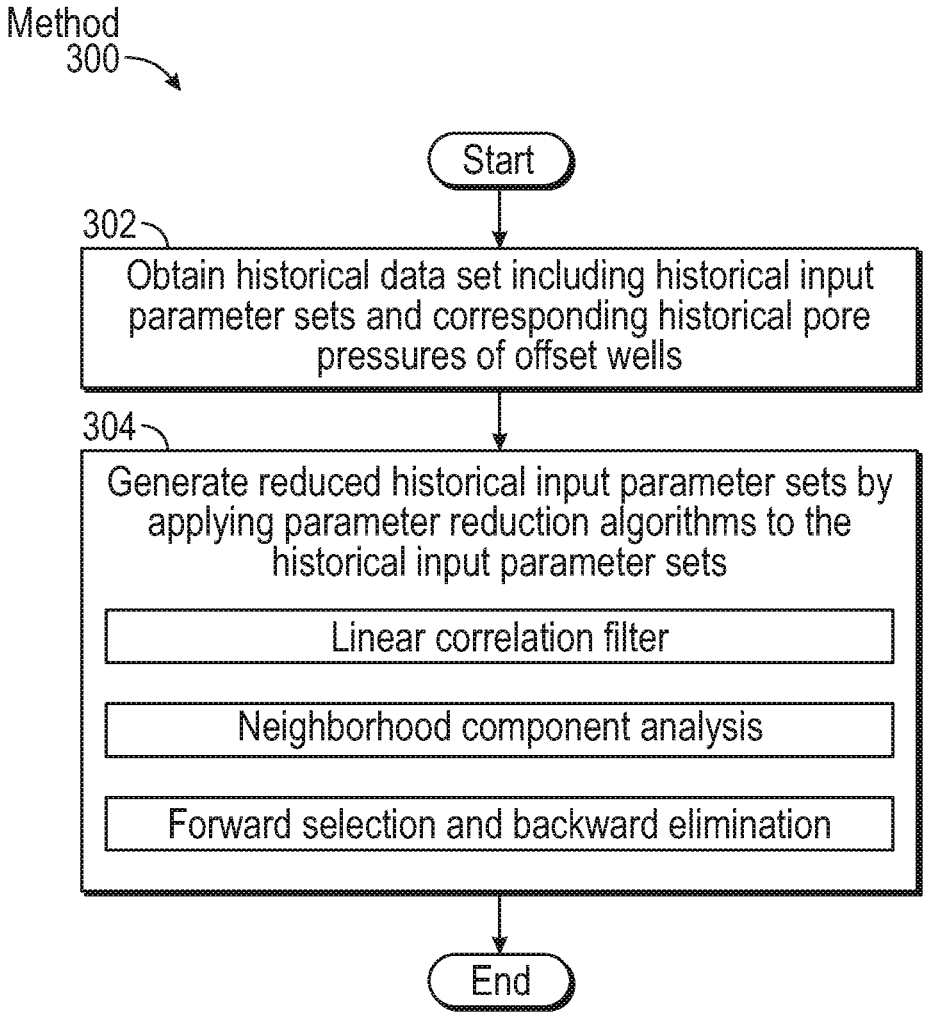
FIG. 3A shows a flowchart of a method for input parameter reduction, in accordance with one or more embodiments.
Figure 3B:
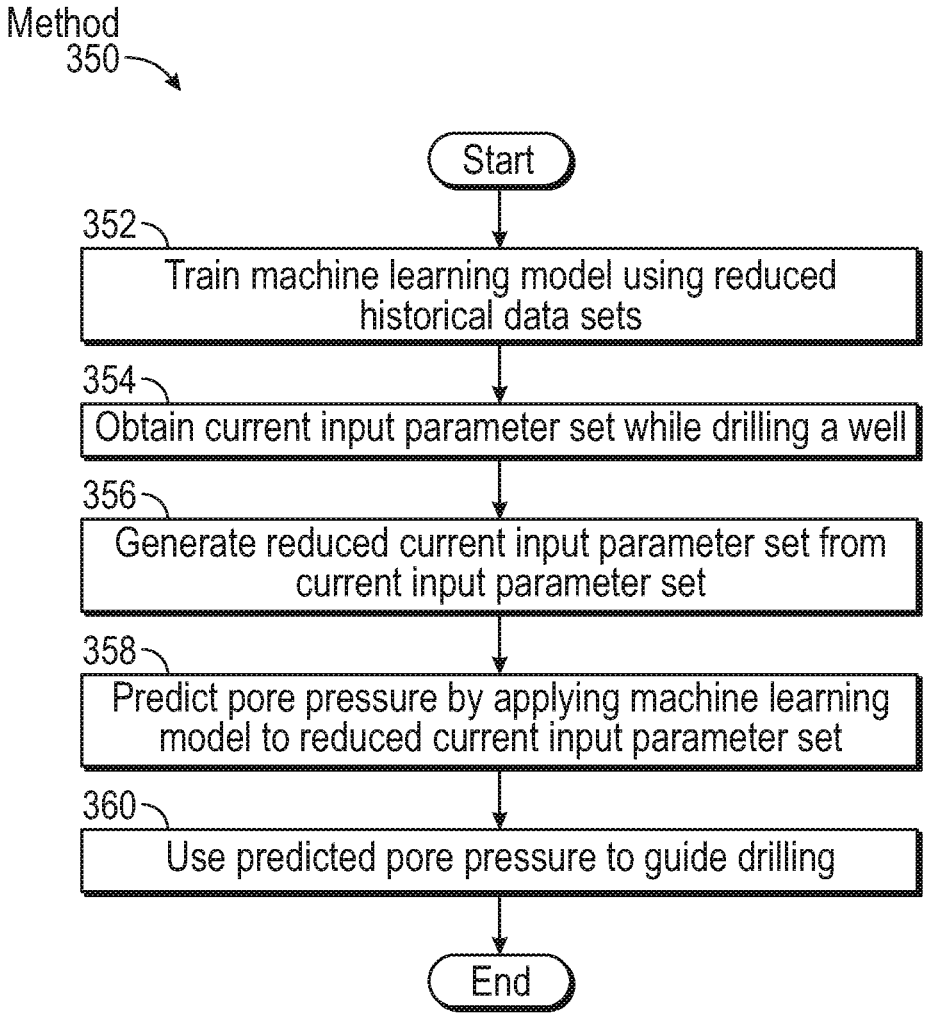
FIG. 3B shows a flowchart of a method for predicting pore pressure, in accordance with one or more embodiments.

FIG. 2A schematically illustrates an input parameter reduction workflow performed in preparation for the formation pore pressure prediction, whereas FIG. 2B schematically illustrates a workflow for predicting pore pressure. FIGS. 3A and 3B show the operations associated with the workflows of FIGS. 2A and 2B, respectively.

The combination of the workflows of FIGS. 2A and 2B leverage the relationship between an input parameter set (with potentially many input parameters) and formation pore pressure. A machine learning model may be used to learn the relationship between the input parameter set and the formation pore pressure. As illustrated in the workflow (200) of FIG. 2A, a dataset including input parameters and corresponding pore pressures may be obtained from a database. The data set may be a historical data set, previously obtained from offset wells. In one or more embodiments, the machine learning model is not trained directly using the historical input parameter set and the corresponding pore pressure measurements that were originally gathered from offset wells. Instead, one or more parameter reduction algorithms are applied to the historical input parameter set to obtain a reduced historical input parameter set. The reduced historical input parameter set may be more suitable (or optimal) for the training of the machine learning model. For example, the reduced input parameter set may be lower-dimensional than the original input parameter set, thereby reducing the volume of data required for training, the computational resource requirements (memory, processor time), etc. The machine learning model, trained using the reduced historical input parameter set may, thus, be more computationally efficient, accurate, and/or robust. Assume, for example, that the original historical input parameter set includes measurements from three data sources (data 1, data 2, data 3). In the example, data 1 includes the surface drilling parameter measurements for rate of penetration (ROP), weight on bit (WOB), torque, revolutions per minute (RPM), hook load, mud flow rate, D-exponent, mud density, standpipe pressure, and mud temperature. Further, in the example, data 2 include the wellbore parameter measurements for gamma ray, sonic, resistivity, and neutron porosity. Also, in the example, data 3 include the advanced mud gas parameters for different gas components including C1, C2, C2S, C3, iC4, nC4, iC5, nC5, Benzene, Toluene, Helium, MethylCycloHexane, CO2, H2, H2S, and TNHC. In the example, the application of the parameter reduction algorithms produces data a, data b, and data c from data 1, data 2, and data 3, respectively. In the example, data a include: ROP, WOB, and mud flow rate. Data b include: gamma ray, sonic, resistivity, and neutron porosity, and data c include C1, C2, and CO2. In other words, the ten surface drilling parameters (data 1) are reduced to three surface drilling parameters (data a); the four wellbore parameter measurements (data 2) are all considered relevant (data b); and the 16 advanced mud gas parameters (data 3) are reduced to three advanced mud gas parameters (data c). In the example, a total of ten rather than 30 input parameters are considered relevant for the purpose of modeling the pore pressure by the machine learning model.

In one or more embodiments, the input parameter reduction is performed by one or more parameter reduction algorithms. Any type of parameter reduction algorithm may be used. For example, a parameter reduction algorithm could be based on linear correlation such as linear regression or nonlinear correlation such as forward selection and backward elimination, or neighborhood component analysis. Simply put, the parameter reduction algorithm may use an iterative process to determine the degree of correlation (linear or nonlinear) between each input parameter and pore pressure. Those parameters that meet a certain threshold such as having below a certain mean squared error would be selected. Any other type of error threshold may be used, without departing from the disclosure.

As illustrated in the workflow (250) of FIG. 2B the machine learning model may be trained using the reduced historical input parameter set and the corresponding pore pressures. After completion of the training, the machine learning model may operate on a reduced input parameter set associated with the well under consideration to predict pore pressure. The prediction may be performed in real-time, during the drilling.

The machine learning model may be any type of machine learning model. Examples for machine learning models that may be used include, but are not limited to, perceptrons, convolutional neural networks, deep neural networks, recurrent neural networks, support vector machines, regression trees, random forests, extreme learning machines, type I and type II fuzzy logic (T1FL/T2FL), decision trees, inductive learning models, deductive learning models, supervised learning models, unsupervised learning models, reinforcement learning models, etc. In some embodiments, two or more different types of machine-learning models are integrated into a single machine-learning architecture, e.g., a machine-learning model may include support vector machines and neural networks.

In some embodiments, various types of machine learning algorithms, e.g., backpropagation algorithms, may be used to train the machine learning models. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the machine-learning model. In some embodiments, historical data, e.g., production data recorded over time may be augmented to generate synthetic data for training a machine learning model.

With respect to neural networks, for example, a neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights for adjusting the data inputs. These network weights may amplify or reduce the value of a particular data input, thereby assigning an amount of significance to various data inputs for a task being modeled. Through machine learning, a neural network may determine which data inputs should receive greater priority in determining one or more specified outputs of the neural network. Likewise, these weighted data inputs may be summed such that this sum is communicated through a neuron's activation function to other hidden layers within the neural network. As such, the activation function may determine whether and to what extent an output of a neuron progresses to other neurons where the output may be weighted again for use as an input to the next hidden layer.

Turning to recurrent neural networks, a recurrent neural network (RNN) may perform a particular task repeatedly for multiple data elements in an input sequence (e.g., a sequence of maintenance data or inspection data), with the output of the recurrent neural network being dependent on past computations (e.g., failure to perform maintenance or address an unsafe condition may produce one or more hazard incidents). As such, a recurrent neural network may operate with a memory or hidden cell state, which provides information for use by the current cell computation with respect to the current data input. For example, a recurrent neural network may resemble a chain-like structure of RNN cells, where different types of recurrent neural networks may have different types of repeating RNN cells. Likewise, the input sequence may be time-series data, where hidden cell states may have different values at different time steps during a prediction or training operation. For example, where a deep neural network may use different parameters at each hidden layer, a recurrent neural network may have common parameters in an RNN cell, which may be performed across multiple time steps. To train a recurrent neural network, a supervised learning algorithm such as a backpropagation algorithm may also be used. In some embodiments, the backpropagation algorithm is a backpropagation through time (BPTT) algorithm. Likewise, a BPTT algorithm may determine gradients to update various hidden layers and neurons within a recurrent neural network in a similar manner as used to train various deep neural networks. In some embodiments, a recurrent neural network is trained using a reinforcement learning algorithm such as a deep reinforcement learning algorithm. For more information on reinforcement learning algorithms, see the discussion below.

Embodiments are contemplated with different types of RNNs. For example, classic RNNs, long short-term memory (LSTM) networks, a gated recurrent unit (GRU), a stacked LSTM that includes multiple hidden LSTM layers (i.e., each LSTM layer includes multiple RNN cells), recurrent neural networks with attention (i.e., the machine-learning model may focus attention on specific elements in an input sequence), bidirectional recurrent neural networks (e.g., a machine-learning model that may be trained in both time directions simultaneously, with separate hidden layers, such as forward layers and backward layers), as well as multidimensional LSTM networks, graph recurrent neural networks, grid recurrent neural networks, etc., may be used. With regard to LSTM networks, an LSTM cell may include various output lines that carry vectors of information, e.g., from the output of one LSTM cell to the input of another LSTM cell. Thus, an LSTM cell may include multiple hidden layers as well as various pointwise operation units that perform computations such as vector addition.

In some embodiments, one or more ensemble learning methods may be used in connection to the machine-learning models. For example, an ensemble learning method may use multiple types of machine-learning models to obtain better predictive performance than available with a single machine-learning model. In some embodiments, for example, an ensemble architecture may combine multiple base models to produce a single machine-learning model. One example of an ensemble learning method is a BAGGing model (i.e., BAGGing refers to a model that performs Bootstrapping and Aggregation operations) that combines predictions from multiple neural networks to add a bias that reduces variance of a single trained neural network model. Another ensemble learning method includes a stacking method, which may involve fitting many different model types on the same data and using another machine-learning model to combine various predictions.

A detailed description of the operations associated with the workflow (200) and workflow (250), including details on the use of the parameter reduction algorithms and the machine learning model is provided below in reference to FIGS. 3A and 3B.

FIGS. 3A and 3B show flowcharts in accordance with one or more embodiments. FIG. 3A shows a method for input parameter reduction, in accordance with one or more embodiments, and FIG. 3B shows a method for predicting pore pressure, in accordance with one or more embodiments.

Execution of one or more blocks in FIGS. 3A and 3B may involve one or more components of the system as described in FIG. 1. While the various blocks in FIGS. 3A and 3B are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Turning to FIG. 3A, the method (300), in one or more embodiments obtains a high-dimensional historical input parameter set to generate a reduced historical input parameter set that is suitable for the prediction of pore pressure. The reduced historical input parameter set may include considerably fewer input parameters than the historical data sets prior to the parameter reduction. Specifically, input parameters that are considered relevant for the purpose of modeling the pore pressure may be kept, whereas input parameters that are considered non-relevant or less relevant may be eliminated. As a result, the reduced historical input parameter set may enable an accurate prediction of pore pressure.

In Block 302, a historical data set is obtained for offset wells. The historical data set may be for any number of offset wells. The historical data set may include a historical input parameter set that may be composed of measurements of different categories (e.g., drilling parameters, logging while drilling parameters, and advanced mud gas data) and corresponding pore pressure measurements. The historical data set may be obtained from a database that stores previously recorded (historical) input parameter set and corresponding pore pressures of offset wells.

In Block 304, a reduced historical input parameter set is generated by applying one or more parameter reduction algorithms to the historical input parameter set. The operations performed in Block 304 may include combining the input parameters in the historical input parameter set in a matrix. The input parameters may be resampled (up- or down-sampled) as needed or desired. Subsequently, a matrix vectorization may be performed. The parameter reduction may then be performed as follows. The parameter reduction algorithms may determine a correlation between each input parameter and pore pressure. Those input parameters that meet certain threshold such as having a mean squared error below a threshold may be selected for the reduced historical input parameter set, whereas the remaining input parameters (input parameters that correlate poorly with the historical pore pressure) may be discarded. Alternatively, the input parameters may be ranked based on correlation with the pore pressure, and a selected number of highest-ranked input parameters may be selected for the reduced historical input parameter set. As a result of selecting the input parameters with the highest correlation with the pore pressure, the reduced historical input parameter set may be considered optimal in that it reduces the number of input parameters while aiming for a maximally accurate prediction of the pore pressure by the machine learning algorithm. Any type of parameter reduction algorithm may be used, including a parameter reduction algorithm that is based on linear correlation such as linear regression or nonlinear correlation such as forward selection and backward elimination, or neighborhood component analysis. The resulting reduced historical input parameter set may be used to train a machine learning model, as further discussed below.

Turning to FIG. 3B, the method (350), in one or more embodiments uses the reduced historical data set including the reduced historical input parameter set and the corresponding pore pressures to train a machine learning model. The machine learning model is trained to predict pore pressure based on the reduced historical input parameter set. Subsequently, the trained machine learning model may be used to predict pore pressure.

In Block 352, the reduced historical data, including the reduced historical input parameters, generated in Block 304 of FIG. 3A and the corresponding pore pressures are used to train the machine learning model. The type of training may depend on the type of machine learning model, as previously discussed. The reduced historical data may be split into a training subset and a validation subset. For example, 80% may be used for training, and 20% may be used for validation. The training may be iterative and may be continued until the trained machine learning model, during the validation, produces a prediction error below an error threshold, or alternatively until no further reduction in the prediction error can be achieved. The training may involve adjustment of the weight coefficients, and may further involve adjustment of hyperparameters, including the learning rate, the number of neurons, the number of layers, the type of activation function, etc. Once the machine learning model is considered trained, the method may proceed with the execution of Block 354.

In Block 354, a current input parameter set is obtained, e.g., while drilling a well. The current input parameter set may include many input parameters, including input parameters corresponding to those in the reduced historical input parameter set.

In Block 356, a reduced current input parameter set is generated from the current input parameter set. The reduced current input parameter set, in one or more embodiments, is in a format identical to the format used for the reduced historical input parameter set. Accordingly, if the historical input parameter set is represented in a particular vector format, the exact same vector format is used for the reduced current input parameter set.

In Block 358, the pore pressure is predicted for the well under consideration. The pore pressure prediction may be performed by applying the trained machine learning model to the reduced current input parameter set. The prediction may be performed in real-time, during the drilling. Entire pore pressure logs may be predicted, for the entire well, for a zone of interest, or for a zone for which a current input parameter set is available.

In Block 360, the predicted pore pressure may be used to guide the ongoing drilling. For example, the weight on bit may be dynamically adjusted to prevent various drilling issues such as a blowout, gas kicks, a stuck pipe, fluid influx, and/or lost circulation, thereby increasing safety and increasing drilling efficiency. Further, the drilling mud properties such as density and rheology may be dynamically adjusted, thereby increasing rate of penetration. The predicted pore pressure may, thus, be highly relevant for well control and geosteering. Other potential uses include, but are not limited to, dynamically determining optimal casing points while drilling, dynamically detecting zones of poor quality LWD measurements, and dynamically detecting zones of hydrocarbon existence.

In one or more embodiments, as the drilling progresses, actual pore pressure measurements may become available. The actual pore pressure measurements and the corresponding input parameter set may be used to retrain and refine the machine learning model.

Figure 4:
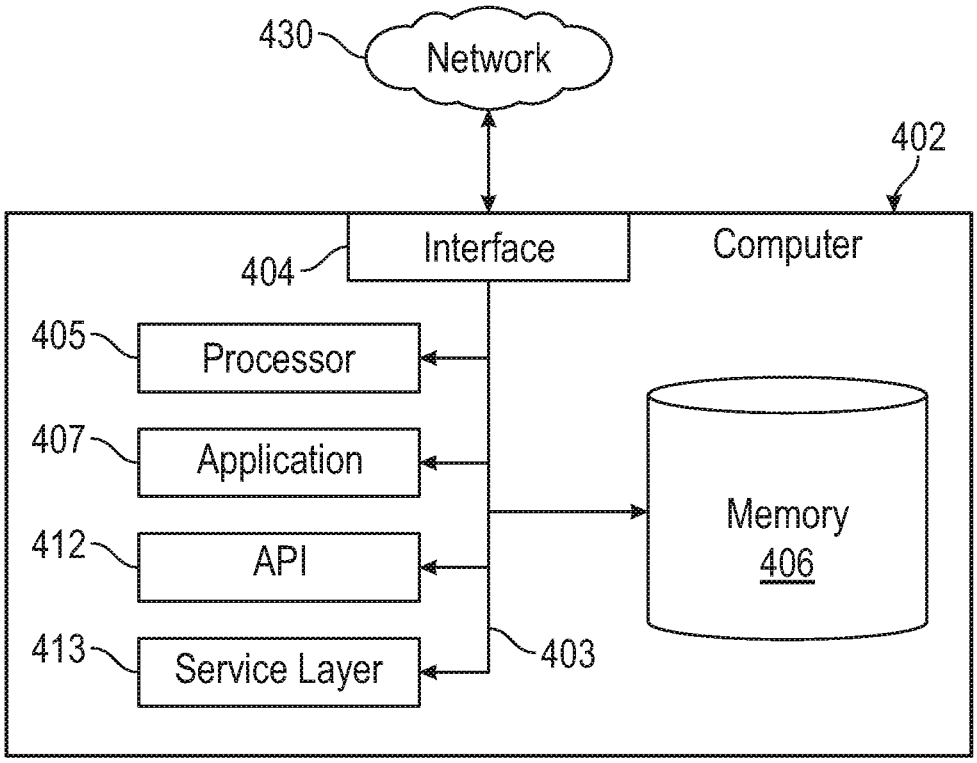
FIG. 4 shows a computer system in accordance with one or more embodiments.

Embodiments may be implemented on a computer system. FIG. 4 is a block diagram of a computer system (402) used to provide computational functionalities associated with described algorithms, methods, functions, processes, flows, and procedures as described in the instant disclosure, according to an implementation. The illustrated computer (402) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404 includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

In some embodiments, the computer (402) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed is:

1. A method for formation pore pressure prediction, the method comprising:

obtaining an input parameter set while drilling a well, the input parameter set comprising:
surface drilling parameters,
logging while drilling parameters, and
advanced mud gas measurements;

obtaining a historical data set from an offset well, the historical data set comprising:
a historical input parameter set, and
historical pore pressure;

identifying at least one input parameter of the input parameter set that is considered non-relevant for predicting the pore pressure by determining that the at least one input parameter that is considered non-relevant has a mean squared error greater than a threshold selected for the historical pore pressure;

generating, from the input parameter set, a reduced input parameter set, by eliminating the at least one input parameter of the input parameter set that is considered non-relevant;

predicting the pore pressure by applying a machine learning model to the reduced input parameter set; and guiding the drilling of the well using the predicted pore pressure;

wherein determining the at least one input parameter of the input parameter set that is considered non-relevant for predicting the pore pressure comprises at least one of:
a linear correlation filter,
a neighborhood components analysis, and
a forward selection and backward elimination.

2. The method of claim 1, wherein the prediction of the pore pressure is performed in real-time, while drilling the well.

3. The method of claim 1, wherein the surface drilling parameters comprise at least one selected from the group consisting of:
a rate of penetration (ROP),
a weight on bit (WOB),
a torque,
revolutions per minute (RPM),
a hook load,
a mud flow rate,
a D-exponent,
a mud density,
a standpipe pressure, and
a mud temperature.

4. The method of claim 1, wherein the logging while drilling parameters comprise at least one selected from the group consisting of:
gamma ray data,
sonic data,
resistivity data, and
neutron porosity recordings.

5. The method of claim 1, wherein the advanced mud gas measurements comprise at least one selected from the group consisting of:
C1, C2, C2S, C3, iC4, nC4, iC5, nC5, Benzene, Toluene, Helium, MethylCycloHexane, CO2, H2, and H2S.

6. The method of claim 1, further comprising:
generating a reduced historical input parameter set by eliminating the at least one input parameter that is considered non-relevant from the historical input parameter set.

7. The method of claim 6, further comprising:
training the machine learning model using the reduced historical input parameter set and the historical pore pressure.

8. A system for formation pore pressure prediction, the system comprising:

a database comprising a historical data set from an offset well, the historical data set comprising:
a historical input parameter set, and
historical pore pressure;

at least one processor configured to:

receive an input parameter set while drilling a well, the input parameter set comprising:
surface drilling parameters,
logging while drilling parameters, and
advanced mud gas measurements;

obtain the historical input parameter set from the database;

identify at least one input parameter that is considered non-relevant by determining that the at least one input parameter that is considered non-relevant has a mean squared error greater than a threshold selected for the historical pore pressure;

generate, from the input parameter set, a reduced input parameter set, by eliminating the at least one input parameter of the input parameter set that is considered non-relevant;

predict the pore pressure by applying a machine learning model to the reduced input parameter set; and guiding the drilling of the well using the predicted pore pressure;

wherein determining the at least one input parameter of the input parameter set that is considered non-relevant for predicting the pore pressure comprises at least one of:
a linear correlation filter,
a neighborhood components analysis, and
a forward selection and backward elimination.

9. The system of claim 8, wherein the surface drilling parameters comprise at least one selected from the group consisting of:
a rate of penetration (ROP),
a weight on bit (WOB),
a torque,
revolutions per minute (RPM),
a hook load,
a mud flow rate, a D-exponent,
a mud density,
a standpipe pressure, and
a mud temperature.

10. The system of claim 8, wherein the logging while drilling parameters comprise at least one selected from the group consisting of:
gamma ray data,
sonic data,
resistivity data, and
neutron porosity recordings.

11. The system of claim 8, wherein the advanced mud gas measurements comprise at least one selected from the group consisting of:
C1, C2, C2S, C3, iC4, nC4, iC5, nC5, Benzene, Toluene, Helium, MethylCycloHexane, CO2, H2, and H2S.

12. The system of claim 8, wherein the at least one processor is further configured to:
generate a reduced historical input parameter set by eliminating the at least one input parameter that is considered non-beneficial from the historical input parameter set.

13. The system of claim 12, wherein the at least one processor is further configured to:
train the machine learning model using the reduced historical input parameter set and the historical pore pressure.

14. A non-transitory machine-readable medium comprising a plurality of machine-readable instructions executed by one or more processors, the plurality of machine-readable instructions causing the one or more processors to perform operations comprising:
obtaining an input parameter set while drilling a well, the input parameter set comprising:
surface drilling parameters,
logging while drilling parameters, and
advanced mud gas measurements;
obtaining a historical data set from an offset well, the historical data set comprising:
a historical input parameter set, and
historical pore pressure;
identifying at least one input parameter of the input parameter set that is considered non-relevant for predicting the pore pressure by determining that the at least one input parameter that is considered non-relevant has a mean squared error greater than a threshold selected for the historical pore pressure;
generating, from the input parameter set, a reduced input parameter set, by eliminating the at least one input parameter of the input parameter set that is considered non-relevant;
predicting the pore pressure by applying a machine learning model to the reduced input parameter set; and
guiding the drilling of the well using the predicted pore pressure;
wherein determining the at least one input parameter of the input parameter set that is considered non-relevant for predicting the pore pressure comprises at least one of:
a linear correlation filter,
a neighborhood components analysis, and
a forward selection and backward elimination.

* * * * *